United States Patent [19]

Tsunetsugu

[11] 4,381,083

[45] Apr. 26, 1983

[54] TOILET PAPER HOLDER

[76] Inventor: Takaaki Tsunetsugu, 2-5, Tatsumi Kita, 4-chome, Ikuno-ku, Osaka, Japan

[21] Appl. No.: 231,067

[22] Filed: Feb. 3, 1981

[30] Foreign Application Priority Data

Jun. 9, 1980 [JP] Japan ..... 55-80776

[51] Int. Cl.[3] ..... B65H 19/00

[52] U.S. Cl. ..... 242/55.2

[58] Field of Search ..... 242/55.2, 55.3, 55.53, 242/55.54; 225/34, 46, 47, 67

[56] References Cited

U.S. PATENT DOCUMENTS

| | | | |
|---|---|---|---|
| 1,198,102 | 9/1916 | Briscoe | 242/55.2 |
| 3,022,957 | 2/1962 | Blunt et al. | 242/55.2 |
| 3,918,661 | 11/1975 | Kishi et al. | 242/55.2 |

FOREIGN PATENT DOCUMENTS

| | | | |
|---|---|---|---|
| 52-143604 | 10/1977 | Japan . | |
| 54-70647 | 5/1979 | Japan . | |
| 350093 | 12/1960 | Switzerland | 242/55.2 |

OTHER PUBLICATIONS

"Living Memorandum 68", Sep., Oct. 1980, pp. 108-111.

*Primary Examiner*—Leonard D. Christian
*Attorney, Agent, or Firm*—Griffin, Branigan & Butler

[57] ABSTRACT

A toilet paper holder wherein one end of a shaft (6) which supports a toilet paper roll (11) is rigidly or rotatably connected to one side plate (5a) of the holder while the other side plate (5b) is hinged to selectively swing away from the holder or to support the other end of the shaft (6).

5 Claims, 5 Drawing Figures

TOILET PAPER HOLDER

BACKGROUND OF THE INVENTION

The present invention pertains to toilet paper holders of a type having a shaft with a roll of toilet paper supported thereon.

Prior art toilet paper holders generally include a base plate mounted on a wall surface; a pair of slide plates forwardly extending from each side edge of the base plate; and, a shaft having a lug on each end portion thereof. A lug on one end portion of a shaft is contractable, enabling the shaft to be suspendingly interposed between the side plates and to accommodate a tubular core of a roll of toilet paper passed around the shaft.

Other conventional prior art toilet paper holders have a cantilevered shaft connected to a single side plate. In such holders, a free end portion of the shaft is overloaded and the holder is stressed in supporting the toilet paper roll.

Exchanging paper rolls in the type of toilet paper holders first described above is generally a rather cumbersome operation. First, the shaft must be axially contracted so that the shaft and a tubular core of a used-up roll of toilet paper may be removed from between the side plates. After removing the tubular core of the used-up roll, the tubular core of a new toilet paper roll must then be passed around the removed shaft. The shaft must then again be contracted and inserted between the two side plates.

In view of the foregoing, an object of the present invention is the provision of a toilet paper holder which facilitates the immediate exchange of toilet paper rolls.

An advantage of the invention is the provision of a toilet paper holder permitting the exchange of toilet paper rolls without the removal of a toilet paper holder shaft.

Yet another advantage of the invention is the provision of a toilet paper holder in which toilet paper rolls may be easily exchanged by children, the aged, or handicapped persons.

SUMMARY

A toilet paper holder is provided wherein one end of a shaft which supports a toilet paper roll is either rigidly or rotatably connected to one of two side plates. The other side plate is hinged to selectively swing away from the holder or to support the other end of the shaft.

BRIEF DESCRIPTION OF THE DRAWINGS

The foregoing and other objects, features and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
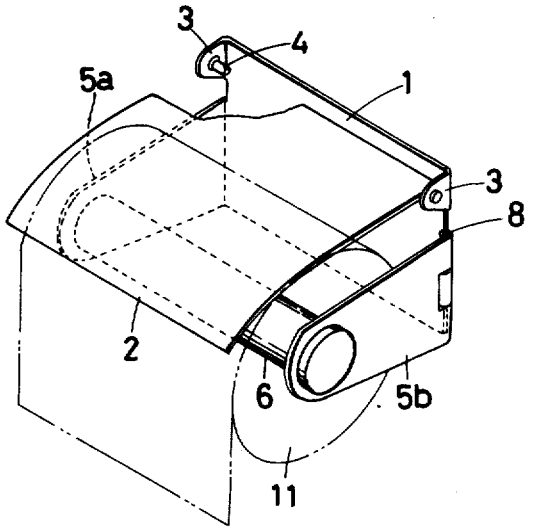
FIG. 1 is a perspective partially cut-away view of a toilet paper holder according to one embodiment of the present invention.
Figure 2:
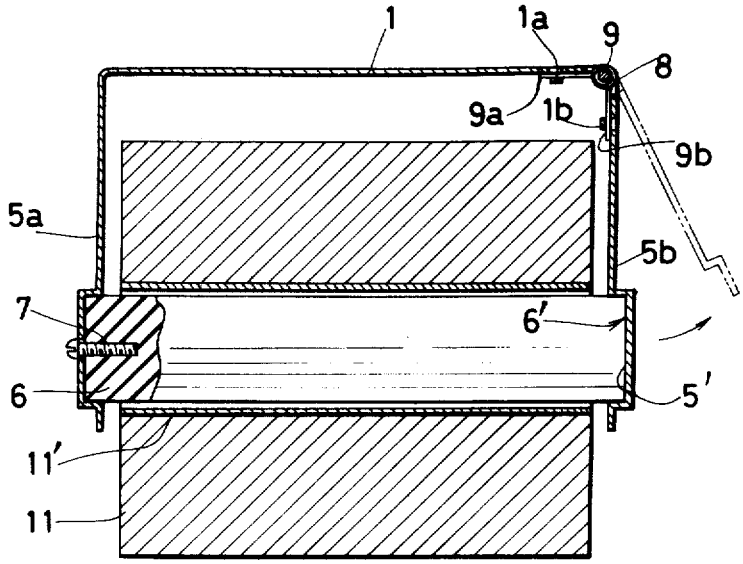
FIG. 2 is a sectional top view of FIG. 1.

The toilet paper holder of FIG. 1 comprises a square base plate 1 mounted on a support surface, such as a vertical wall surface, by appropriate fastening means (not illustrated). A paper cover 2 having a front edge constructed as a paper cutter is attached to brackets 3 formed integral with the upper edges of base plate 1. Paper cover 2 is swingably supported by pins 4 which fit through holes in the brackets 3 and through the paper cover 2. Left and right side plates (5*a* and 5*b*, respectively) extend forwardly in parallel fashion from respective side edges of the base plate 1. Side plate 5*a* is affixed to or is integral with base plate 1. A shaft 6 is connected in cantilever fashion by means of welding or, as shown in FIG. 2, by a screw 7 to an inner surface of a forward portion of side plate 5*a*.

The other side plate 5*b* is connected to base plate 1 by hinge means 8 so that side plate 5*b* can selectively swing toward or away from (as depicted by an arrow in the FIGS.) the toilet paper holder. Hinge 8 is wound by a spring 9. Spring 9 has ends 9*a*, 9*b* retained by respective hooks 1*a*, 1*b* which are formed by slitting and deforming of base plate 1 and side plate 5*b*. Alternatively, the spring end portions 9*a*, 9*b* may be attached to the outer surfaces of base plate 1 and side plate 5*b*, thereby avoiding deformation of those members.

Side plate 5*b* is further provided with a bearing recess 5' at a forward inside portion thereof. Side plate 5*b* can be swung inwardly toward the holder so that the bearing recess 5' engages a free end face 6' of shaft 6. As a result, shaft 6 is supported by side plate 5*b* in addition to the support provided by side plate 5*a*.

Figure 5:
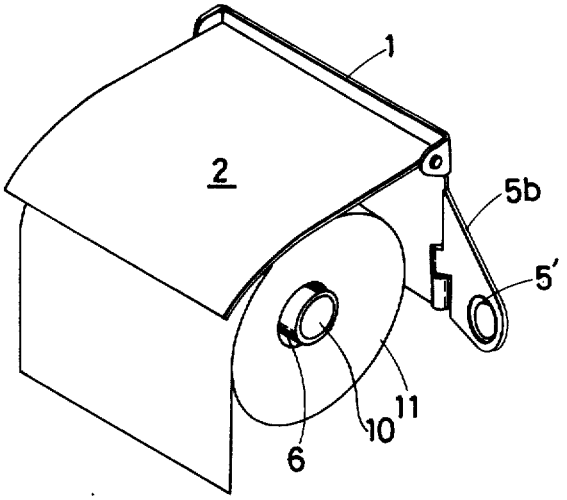
FIG. 5 is a perspective view of a toilet paper holder according to an embodiment of the present invention showing a side plate swung away from the holder.
Figure 3:
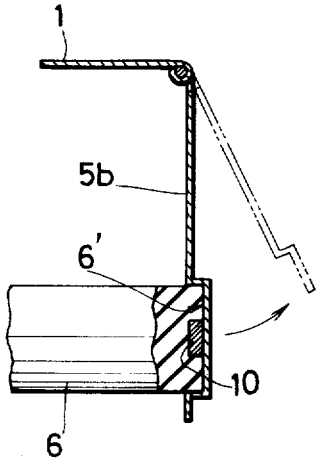
FIG. 3 is a partial top view, partially sectioned, of another embodiment.

FIGS. 3 and 5 illustrate another embodiment wherein side plate 5*b* is rotatably mounted relative to base plate 1 by the hinge plate 8 without usage of a spring.

The various elements of the toilet paper holders of the present invention may be made from any suitable material, such as metal, plastic, or wood, for example. When shaft 6 is metallic, a magnet 10 (as illustrated in FIG. 3) may be provided on the bearing recess 5' of side plate 5*b* which engages the shaft 6. Conversely, when the side plate 5*b* including bearing recess 5' is metallic, the magnet may be provided at the end of shaft 6.

Figure 4:
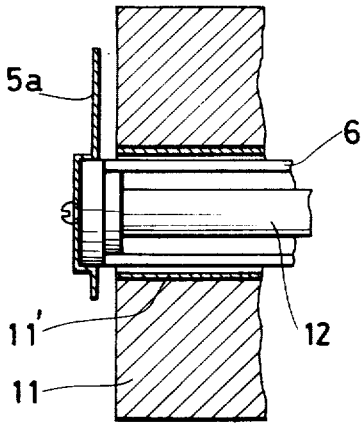
FIG. 4 is a sectioned partial top view of another embodiment.

As shown in FIG. 4, a roll of toilet paper 11 has a tubular core 11' which is loosely passed over shaft 6 in such a manner that the roll 11 is supported on shaft 6. In the embodiment shown in FIG. 4, shaft 6 is rotatable together with the paper roll 11. In this respect, shaft 6 is tubular and includes a core-flanged shaft 12. The tubular shaft 6 is rotated around the flanged portion of the core shaft 12, the core shaft 12 being connected to the side plate 5*a*.

In operation, rolls of toilet paper may be quickly exchanged in the following manner. The paper cover 2 is rotated about pins 4 to an erect position where the cover 2 rests against the support wall. Side plate 5*b* is then swung about hinge 8 away from the toilet paper holder in the direction of the illustrated arrows (as in FIGS. 2 and 3), leaving the shaft 6 supported in cantilever fashion. The tubular core 11' of the old toilet paper roll can now be easily slid in an axial direction away from the shaft 6 without removing or repositioning the shaft 6. A new toilet paper roll can be positioned by having its tubular core 11' passed over the shaft in the reverse axial direction. Thereafter side plate **5*b* can be returned toward the holder in the direction opposite the illustrated arrows so that bearing recess 5' engages the shaft 6**. Accordingly, the present toilet paper holder facilitates the immediate and easy exchange of toilet paper rolls without the necessity of removing the support shaft as required in conventional holders.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. A toilet paper holder comprising:

a base plate mountable on a support surface;

a first side plate connected to a first edge of said base plate;

a second side plate rotatably mounted about an opposite edge of said base plate, said second side plate being metallic and having a shaft-engaging recess provided therein; and, a non-removable paper roll-supporting shaft, said shaft having a first end connected to said first side plate, said shaft also having a second end with a magnet provided thereon, said second end of said shaft being adapted (1) to fit into said shaft-engaging recess of said second side plate when said second side plate is positioned for engagement with said shaft and (2) to extend from said first side plate in cantilever fashion when said second side plate is rotated away from said shaft so that paper rolls may be exchanged without moving said shaft.

2. A toilet paper holder comprising:

a base plate mountable on a support surface;

a first side plate connected to a first edge of said base plate;

a second side plate rotatably mounted about an opposite edge of said base plate, said second side plate having a shaft-engaging recess provided therein with a magnet on said recess; and, a non-removable paper roll-supporting shaft, said shaft having a first end connected to said first side plate, said shaft also having a second end which is metallic and adapted (1) to fit into said shaft-engaging recess of said second side plate when said second side plate is positioned for engagement with said shaft and (2) to extend from said first side plate in cantilever fashion when said second side plate is rotated away from said shaft so that paper rolls may be exchanged without moving said shaft.

3. The toilet paper holder of claims 1 or 2, wherein said shaft is rigidly connected to said first side plate.

4. The toilet paper holder of claims 1 or 2, wherein said shaft is rotatably disposed about a second shaft internally concentric to said first shaft, and wherein said second shaft is rigidly connected to said first side plate.

5. The toilet paper holder of claims 1 or 2 further comprising a spring member having a first end connected to said base plate and a second end connected to said second side plate, said spring member adapted to facilitate said rotation of said second side plate.

* * * * *